United States Patent [19]

Carter

[11] Patent Number: 4,822,043

[45] Date of Patent: Apr. 18, 1989

[54] BASEBALL CARD GAME

[76] Inventor: Lewis S. Carter, No. 3, The Tower, Chapel Hill, N.C. 27514

[21] Appl. No.: 30,710

[22] Filed: Mar. 25, 1987

[51] Int. Cl.[4] ..... A63F 1/04

[52] U.S. Cl. ..... 273/93 C; 273/88; 273/146

[58] Field of Search ..... 273/93 R, 93 C, 91, 273/88

[56] References Cited

U.S. PATENT DOCUMENTS

| | | | |
|---|---|---|---|
| 1,552,617 | 9/1925 | Kisor | 273/93 R |
| 1,581,189 | 4/1926 | Fuchs | 273/93 R |
| 2,825,564 | 3/1958 | Macht et al. | 273/93 R |
| 3,705,723 | 12/1972 | Eissler | 273/89 |
| 4,210,335 | 7/1980 | Licciardi | 273/288 |
| 4,261,569 | 4/1981 | Frohlich | 273/93 R |
| 4,378,115 | 3/1983 | Terrero | 273/93 C |
| 4,634,125 | 1/1987 | Seklecki | 273/93 C |

FOREIGN PATENT DOCUMENTS

| | | | |
|---|---|---|---|
| 2154148 | 9/1985 | United Kingdom | 273/268 |

*Primary Examiner*—Richard C. Pinkham
*Assistant Examiner*—William E. Stoll
*Attorney, Agent, or Firm*—Steven J. Hultquist; Lynn E. Barber

[57] ABSTRACT

A baseball game suitable for table play, comprising: a random character generator; at least one park card containing a series of characters generatable by the random character generator and corresponding play events; a series of play action cards, having on a first side thereof a listing of player positions, numerical fielding ratings for the positions, and a play event for each of the fielding ratings for each player position; and on a second side thereof a series of play events in designated event categories; a set of player cards, including batter/fielder cards and pitcher cards, each of the player cards comprising a series of characters generatable by the random character generator and a series of corresponding play events, some of which designate outcome play events on one of the home park card and the play action cards. The game is adapted to be played in a basic game embodiment by one or two players in a short time of from about 15 to 30 minutes. A master's game embodiment may be played by two players in a slightly longer time period of 45 to 60 minutes, and entails opportunities for complex strategy and tactics by each of the opposing game players.

18 Claims, 9 Drawing Sheets

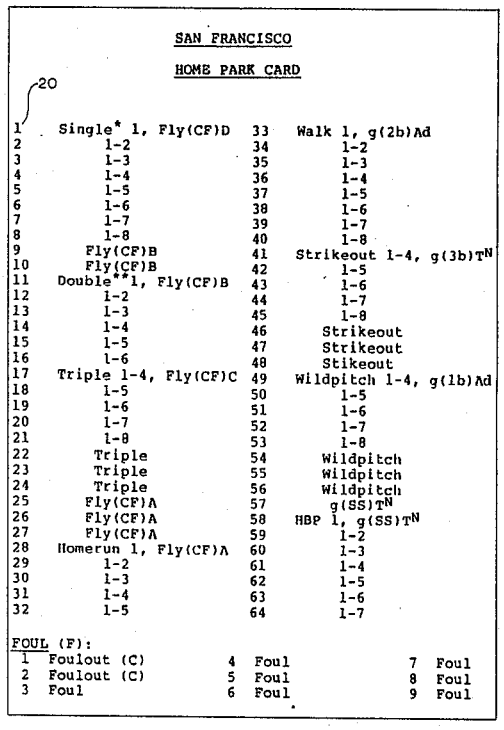

SAN FRANCISCO

HOME PARK CARD

20

| | | | |
|---|---|---|---|
| 1 | Single* 1, Fly(CF)D | 33 | Walk 1, g(2b)Ad |
| 2 | 1-2 | 34 | 1-2 |
| 3 | 1-3 | 35 | 1-3 |
| 4 | 1-4 | 36 | 1-4 |
| 5 | 1-5 | 37 | 1-5 |
| 6 | 1-6 | 38 | 1-6 |
| 7 | 1-7 | 39 | 1-7 |
| 8 | 1-8 | 40 | 1-8 |
| 9 | Fly(CF)B | 41 | Strikeout 1-4, g(3b)T$^N$ |
| 10 | Fly(CF)B | 42 | 1-5 |
| 11 | Double** 1, Fly(CF)B | 43 | 1-6 |
| 12 | 1-2 | 44 | 1-7 |
| 13 | 1-3 | 45 | 1-8 |
| 14 | 1-4 | 46 | Strikeout |
| 15 | 1-5 | 47 | Strikeout |
| 16 | 1-6 | 48 | Stikeout |
| 17 | Triple 1-4, Fly(CF)C | 49 | Wildpitch 1-4, g(1b)Ad |
| 18 | 1-5 | 50 | 1-5 |
| 19 | 1-6 | 51 | 1-6 |
| 20 | 1-7 | 52 | 1-7 |
| 21 | 1-8 | 53 | 1-8 |
| 22 | Triple | 54 | Wildpitch |
| 23 | Triple | 55 | Wildpitch |
| 24 | Triple | 56 | Wildpitch |
| 25 | Fly(CF)A | 57 | g(SS)T$^N$ |
| 26 | Fly(CF)A | 58 | HBP 1, g(SS)T$^N$ |
| 27 | Fly(CF)A | 59 | 1-2 |
| 28 | Homerun 1, Fly(CF)A | 60 | 1-3 |
| 29 | 1-2 | 61 | 1-4 |
| 30 | 1-3 | 62 | 1-5 |
| 31 | 1-4 | 63 | 1-6 |
| 32 | 1-5 | 64 | 1-7 |

FOUL (F):

| | | | | | |
|---|---|---|---|---|---|
| 1 | Foulout (C) | 4 | Foul | 7 | Foul |
| 2 | Foulout (C) | 5 | Foul | 8 | Foul |
| 3 | Foul | 6 | Foul | 9 | Foul |

ALL GROUNDBALLS (If bases empty, batter out

10 gL -- (If runner on firstbase only) -- treat as gT gL -- (If runner on another base) -- lead runner out, batter safe, others advance gL -- (If runner on first and another base)-- treat as gT or lead runner out, batter safe, others advance gT -- If runner is forced at second, then the runner and batter are out (double-play), others advance gT -- If no runner forced, batter out, runners hold gF -- If runner is forced at second, then the runner is out, batter safe, others advance gF -- If no runner forced, batter out, others hold gAd -- Batter out, runners advance N -- If any fielder playing "IN", then single**.

12

IF INFIELD "IN":-- gL -- Lead runner out, batter safe; others advance. If bases loaded, this is a home-to-firstbase DP.

gT -- Lead runner out, batter safe, others advance.

gF -- Batter out, runners hold unless forced.

gAd -- Batter out, runners advance.

FIG. 1a

13

F L Y B A L L S (Batter always out)

Fly (OF) A --Any runner may try to advance vs. OF (+2).

Fly (OF) B --Any runner may try to advance vs. OF (-1).

Fly (OF) C --Runner on third scores, others hold.

FLY (OF) D --Runners hold.

O U T S Y M B O L S

| | | | |
|---|---|---|---|
| K | -- strikeout | | |
| walk | -- walk | | |
| Pop(pos) | -- popout | | |
| g(pos) | -- groundout | | |
| Live(pos) | -- liveout | * | -- runners advance 1 base |
| fly(OF) | -- flyout | | |
| 1b | -- single | ** | -- runners advance 2 bases |
| 2b | -- double | *** | -- runners advance 3 bases |
| 3b | -- triple | | |
| HR | -- Homerun | | |

14

| | | |
|---|---|---|
| (P) | -- | pitcher |
| (C) | -- | catcher |
| (1b) | -- | firstbase |
| (2b) | -- | secondbase |
| 15 → (3b) | -- | thirdbase |
| (SS) | -- | shortstop |
| (LF) | -- | leftfielder |
| (CF) | -- | centerfielder |
| (RF) | -- | rightfielder |

FIG. 1b

SAN FRANCISCO

HOME PARK CARD

20

| | | | |
|---|---|---|---|
| 1 | Single* 1, Fly(CF)D | 33 | Walk 1, g(2b)Ad |
| 2 | 1-2 | 34 | 1-2 |
| 3 | 1-3 | 35 | 1-3 |
| 4 | 1-4 | 36 | 1-4 |
| 5 | 1-5 | 37 | 1-5 |
| 6 | 1-6 | 38 | 1-6 |
| 7 | 1-7 | 39 | 1-7 |
| 8 | 1-8 | 40 | 1-8 |
| 9 | Fly(CF)B | 41 | Strikeout 1-4, g(3b)$T^N$ |
| 10 | Fly(CF)B | 42 | 1-5 |
| 11 | Double**1, Fly(CF)B | 43 | 1-6 |
| 12 | 1-2 | 44 | 1-7 |
| 13 | 1-3 | 45 | 1-8 |
| 14 | 1-4 | 46 | Strikeout |
| 15 | 1-5 | 47 | Strikeout |
| 16 | 1-6 | 48 | Stikeout |
| 17 | Triple 1-4, Fly(CF)C | 49 | Wildpitch 1-4, g(1b)Ad |
| 18 | 1-5 | 50 | 1-5 |
| 19 | 1-6 | 51 | 1-6 |
| 20 | 1-7 | 52 | 1-7 |
| 21 | 1-8 | 53 | 1-8 |
| 22 | Triple | 54 | Wildpitch |
| 23 | Triple | 55 | Wildpitch |
| 24 | Triple | 56 | Wildpitch |
| 25 | Fly(CF)A | 57 | g(SS)$T^N$ |
| 26 | Fly(CF)A | 58 | HBP 1, g(SS)$T^N$ |
| 27 | Fly(CF)A | 59 | 1-2 |
| 28 | Homerun 1, Fly(CF)A | 60 | 1-3 |
| 29 | 1-2 | 61 | 1-4 |
| 30 | 1-3 | 62 | 1-5 |
| 31 | 1-4 | 63 | 1-6 |
| 32 | 1-5 | 64 | 1-7 |

FOUL (F):

| | | | | | |
|---|---|---|---|---|---|
| 1 | Foulout (C) | 4 | Foul | 7 | Foul |
| 2 | Foulout (C) | 5 | Foul | 8 | Foul |
| 3 | Foul | 6 | Foul | 9 | Foul |

FIG. 2

Batter/Fielder's Card

26

CORY SNYDER -- (right) Run: 1-6 Steal: Poor -- 5

Cleveland Indians '86 Bunt: Poor Hit & Run: Poor

Injury: 7 29

30

Right or Left Field: $2^{-3}$e8, Third: 3e16DP$^{1}$, Short: 4e25DP$^{0}$ 29 31 29 31 32 31 32

35 .327 vs. Lefthand Pitcher

36 .249 vs. Righthand Pitcher

| | | | | | | | |
|---|---|---|---|---|---|---|---|
| 11 | K | 41 | Homerun | 11 | K | 41 | Homerun |
| 12 | K | 42 | Pitch-44 | 12 | K | 42 | Pitch-44 |
| 13 | K | 43 | Fly(LF)C | 13 | K | 43 | g(SS)T |
| 14 | K | 44 | g(2b)Ad. | 14 | K | 44 | g(3b)F |
| 15 | K | 45 | g(SS)F | 15 | K | 45 | Fly(LF)A |
| 16 | K | 46 | g(3b)T | 16 | K | 46 | K |
| 21 | single** | 51 | g(SS)T | 21 | K | 51 | K |
| 22 | single** | 52 | K | 22 | K | 52 | K |
| 23 | single(LF) | 53 | K | 23 | single** | 53 | K |
| 24 | single(CF) | 54 | K | 24 | single** | 54 | K |
| 25 | single* | 55 | K | 25 | double** | 55 | K |
| 26 | double(LF) | 56 | Play-X | 26 | double(LF) | 56 | Play-X |
| 31 | Park-3 | 61 | Play-X | 31 | Park-2 | 61 | Play-X |
| 32 | Park-7 | 62 | Play-X | 32 | Park-6 | 62 | Play-X |
| 33 | Park-13 | 63 | Play (LF) | 33 | Park-12 | 63 | Play(LF) |
| 34 | Park-18 | 64 | Play (CF) | 34 | Park-17 | 64 | Play(CF) |
| 35 | Park-22 | 65 | Play (RF) | 35 | Park-21 | 65 | Play(RF) |
| 36 | Park-38 | 66 | Action | 36 | Park-37 | 66 | Action |

34

34

FIG. 3

43 40 PITCHER'S CARD

ROGER CLEMENS (right) 45 44 47a 47

Boston Red Sox '86 42 Injury -- 0 Pitcher: 2 e6

Starter (8), Relief (0) 46 Hold -- 0 Control: 2

Balk -- 1

50 .280 with bases empty 52 .240 with man on base

| | | | | | | | |
|---|---|---|---|---|---|---|---|
| 11 | play (SS) | 41 | K | 11 | play (SS) | 41 | K |
| 12 | play (SS) | 42 | K | 12 | play (SS) | 42 | K |
| 13 | play (2b) | 43 | K | 13 | play (2b) | 43 | K |
| 14 | play (2b) | 44 | Park-17 | 14 | play (2b) | 44 | Park-19 |
| 15 | play (3b) | 45 | K | 15 | play (3b) | 45 | K |
| 16 | play (1b) | 46 | g(p)B | 16 | play (1b) | 46 | K |
| 21 | play (P) | 51 | single* | 21 | play (P) | 51 | g(p)B |
| 22 | play (C) | 52 | single* | 22 | play (C) | 52 | single** |
| 23 | K | 53 | Park-7 | 23 | K | 53 | Park-8 |
| 24 | K | 54 | Park-3 | 24 | K | 54 | Park-4 |
| 25 | K | 55 | Park-22 | 25 | K | 55 | Park-23 |
| 26 | K | 56 | Park-27 | 26 | K | 56 | Park-28 |
| 31 | K | 61 | Park-31 | 31 | K | 61 | Park-32 |
| 32 | K | 62 | Park-37 | 32 | K | 62 | Park-38 |
| 33 | K | 63 | Walk | 33 | K | 63 | Walk |
| 34 | K | 64 | pop(SS) | 34 | K | 64 | Walk |
| 35 | K | 65 | fly(RF)D | 35 | K | 65 | Fly(LF)D |
| 36 | K | 66 | fly(LF)D | 36 | K | 66 | Fly(RF)B |

FIG. 4

60 PLAY -- CHANCES 62 64

| POSITION | 1 | 2 | 3 | 4 | 5 |
|---|---|---|---|---|---|
| PITCHER e-16 or: | gL | gL | gL | gT | gF |
| CATCHER e-4 or: | pop out | pop out | pop out | pop out | pop out |
| FIRST BASE | line max. | line max. | line max. | 2b*** | 2b*** |
| SECOND BASE | gT | gT | gT | 1b** | 1b** |
| THIRD BASE e-13 or: | gT | gT | gT | gT | 1b** |
| SHORTSTOP e-9 or: | gT | gT | gT | gT | gT |
| LEFT FIELD | fly D | fly B | fly C | fly A | 1b* |
| CENTER FIELD | fly D | fly C | fly A | 2b*** | 2b*** |
| RIGHT FIELD e-5 or: | fly D | fly A | fly A | fly A | fly A |

INFIELD ERROR DESCRIPTION --pitcher and catcher only: 1-base

66

Others: dropped pop-up, 1-base. (If runner on first and less than 2 out, batter out on infield fly rule, runners may try to advance (-1).

OUTFIELD ERROR DESCRIPTION -- 2-base. (Runners score, batter may try for third vs. OF (0).

68

FIG. 5a

| | |
|---|---|
| PARK 6 | PLAY-X g(2b)Ad. (If any fielder IN, 1b**). |
| ACTION: | 11 - 16: If runner is on third, runner out for interfering with baseman's attempt to catch pop-up. Batter also ruled out; or, HBP, batter injured this game and 1x injury.<br>21 - 66: g(3b)Ad. Batter injured this game only. |
| 82 RUNNING 5 | STEAL 2B: (ball) 1 (83) |
| STEAL 3B OUT (84) (86) | STEAL HOME: (85) Unless count is 3-2, 3-1, 3-0 2-1, or 2-0, pitchout (ball) runner steals (-1); or, (strike) -7. (If double-steal, (strike) -6. |
| BUNT: | g(1b)Ad. (If this fielder IN, lead runner out, batter safe, others advance. |
| HIT-AND-RUN: (87) | Good g(2b)Ad.<br>Others --Batter misses pitch, runner must steal (-1). |
| DOUBLE STEAL: (88) | 11 - 16: Batter misses sign, see bunt play.<br>21 - 66: (ball), trailer steals vs. catcher (-1); lead runner steals vs. second-baseman:<br>(1) -1 (2) 0 (3) +1 (4) +2 (5) +3 |
| (90) HOLD: | (-1) |
| PICK-OFF: (91) | Runner trapped off base and must steal vs. pitcher's hold (-1). Others may try to advance vs. basemen:<br>(1) -2 (2) -1 (3) 0 (4) +1 (5) +2 |
| TAKE: (89) | If lead runner's steal frequency is good, BALL; or, STRIKE. |
| PITCHER TIRED: (80) | single** |

FIG. 5b

CURVEBALL

FIG. 6

FASTBALL

IF PITCHER IS "TIRED" AND BATTER GUESSES WRONG FOR THIS PITCH, THEN DRAW PLAY-ACTION CARD FOR "PITCHER TIRED" RESULT.

FIG. 7

-- P I T C H O U T -- (BALL)

-- IF BATTER GUESSES FASTBALL OR CURVEBALL, OR BATTER TAKES PITCH, THEN BALL.

-- IF STEAL PLAY, RUNNER STEALS (-1).

-- IF DOUBLE-STEAL, TRAILER SAFE, CATCHER TRIES TO PICKOFF LEAD RUNNER (-1).

-- IF BUNT, CATCHER TRIES TO PICKOFF LEAD RUNNER (-1); OTHERS HOLD.

-- IF HIT-AND-RUN, RUNNER MUST STEAL (-1).

FIG. 8

BASEBALL CARD GAME

BACKGROUND OF THE INVENTION

1. Field of the Invention

This invention relates to a baseball game simulative of real-life baseball play, which in various embodiments may be played by one or two game players in a short period of time, e.g., on the order of from about fifteen to about sixty minutes.

2. Description of the Related Art

Reflecting the popularity of baseball and its status as the "national pastime," a variety of baseball board games and table baseball games have been developed, which in varying degrees attempt to simulate the activity, strategy, and tactics of real-life baseball play.

An example of one such type of baseball game is disclosed in U.S. Pat. No. 4,261,569 to S. J. Frohlich. The board game of this patent utilizes a board on which a baseball diamond is depicted and markers are employed to represent base runners. A pair of different dice, or other random generators, are used to generate numbers from which the action of the play is determined. The game uses a set of ball player cards, on the face of which is printed the ball player's name, position and a list of possible results from the random number generator. Each of such numbers has associated therewith a play event. The game uses a set of gamble cards each of which contains a symbol for one of a pitcher and a batter, so that there are both pitcher and batter cards in the set, an indication of possible locations of the furthest advanced base runner, and opposite each indication a statement of a play event. The gamble cards are chosen whenever a player rolls a "doubles", i.e., the face value on each die in the set of dice is the same.

In one embodiment of the game disclosed in this patent, the advancement of base runners is determined by reference to a runner reaction chart containing a list of possible batting results. Opposite this list of batting results is a statement of how the various base runners advance for a particular hitting performance, as initially determined on the ball player cards. The patent also discloses to utilize a plurality of separate event cards in place of the ball player cards.

It is an object of the present invention to provide a baseball game which is simple in procedure of play, which typically may be played in a short time, e.g., on the order of from about fifteen minutes to an hour.

It is another object of the invention to provide a baseball game which is adapted to the level of skill, ability, and baseball knowledge of the participant players, offering its players the opportunity to exercise a level of play commensurate with their capabilities, so that sophisticated players may adopt correspondingly complex strategies and tactics.

It is a further object of the invention to provide a historically and statistically-based baseball game which is simulative of real-life major league baseball play.

It is a still further object of the invention to provide a table baseball game which is simple in construction and is easily and quickly learned.

Other objects and advantages of the invention will be more fully apparent from the ensuing disclosure and appended claims.

SUMMARY OF THE INVENTION

In one aspect, the present invention relates to a baseball game, comprising:

(a) A random character generator;

(b) A park card, and preferably a set of such cards from which one may be selected for a specific game, containing (i) a series of characters generatable by the random character generator and (ii) a series of corresponding play events;

(c) A set of play action cards, each play action card having on a first side thereof: a listing of all player positions; a numerical range of fielding ratings for each of such player positions; and a play event for each of such fielding ratings for each player position; and each play action card having on a second side thereof: a series of play event categories; and a series of corresponding play events;

(d) A set of player cards, including batter/fielder-cards and pitcher cards, each of such batter/fielder cards containing a designation of a specific player and playing position, a fielding rating for such position, and for each of the batter performance categories of batting against right-handed pitching and batting against left-handed pitching, (i) a series of characters generatable by said random character generator, and (ii) a series of corresponding play events, some of which designate outcome play events on either the home park card or the play action cards; and each of the pitcher cards containing a designation of a specific player and pitching performance ratings, and for each of the pitching categories of pitching with the bases empty, and pitching with runner(s) on base; (i) a series of characters generatable by the random character generator, and (ii) a series of corresponding play events, some of which designate outcome play events on either the home park card or the play action cards.

In another aspect, the invention relates to a baseball game, as above described, wherein each character on the park card, in the series of characters generatable by the random character generator, designates either one or two play events, and when two play events are designated, each has a numerical range associated therewith, corresponding to numbers further generatable by the random character generator.

Still another aspect of the invention relates to a baseball game as above described, comprising a set of pitch cards, including: a curveball card; a fastball card; and a pitchout card, denoting a series of offensive strategy conditions, and associated outcome play events.

Other aspects and features of the present invention will be more fully apparent from the ensuing disclosure and appended claims.

BRIEF DESCRIPTION OF THE DRAWINGS

FIGS. 1*a* and 1*b* are respective sheets of a "key" for the baseball game of the invention, setting forth the symbols and associated play events denoted thereby, the symbols being used on various of the playing cards utilized in the game.

FIG. 2 is an illustrative home park card used in the baseball game.

FIG. 3 is an illustrative batter/fielder card used in the baseball game.

FIG. 4 is an illustrative pitcher card used in the baseball game.

FIG. 5*a* shows the details of the play-chances face of the play-action card, by which play events are determined as a consequence of the relative fielding ability of a ball player at a particular position faced with a fielding opportunity.

FIG. 5*b* is the face of the play action card on the reverse side of the face shown in FIG. 5*a*, setting forth various play events categories with associated outcomes or determinants.

FIG. 6 is the curveball card of the set of pitch cards utilized in the masters game embodiment of the invention.

FIG. 7 is the fastball card used in the masters game embodiment of the invention.

FIG. 8 is the pitchout card used in the masters game embodiment of the invention.

DETAILED DESCRIPTION OF THE INVENTION, AND PREFERRED EMBODIMENTS THEREOF

The baseball game of the present invention may be played as a "basic game" utilizing as game elements (a) a random character generator, such as an appropriately configured set of dice, described hereinafter in greater detail, (b) a first set of cards designated home park cards, (c) a second set of cards designated play action cards and (d) a third set of cards designated player cards, all as hereinafter more fully described.

The baseball game of the invention, in another embodiment thereof, may also be played as a "master's game", utilizing as game elements the aforementioned elements (a)–(d), together with (e) a fourth set of cards, designated pitch cards.

Prior to describing in detail the playing of the basic and master's game embodiments of the invention, each of the aforementioned elements (a)–(e) will now be described in detail.

The random character generator (a) may, as indicated, be utilized as an appropriately configured set of dice, comprising a first six-faced die, on three faces of which are contained the letter "P" or other symbol designating the labeled with a superscript or subscript "t" designation, as "$P^t$" or "$P_t$", denoting "pitcher tired" status. On the remaining three faces of such die are contained the letter "B" or other symbol designating the batter.

Such first die may be appropriately sized and/or colored to distinguish it from the other dice of the set, as hereinafter described. In practice, it has been found useful to provide such die with a larger size than the remaining dice and with a red color.

The second and third dice in the three-dice set constituting the random character, e.g., alphanumeric generator may be of a conventional type, having six faces numbered by dots representing the numerals 1–6, but with one of such dice larger than the other. The larger die represents an initial number "X", so that when the dice are thrown, the larger die is read first and the smaller die second, to provide a number "XY" in which "X" is from 1 to 6, "Y" being the second digit of the two digit number, and also, having a value of from 1 to 6. In such manner, various permutation the dice are possible, to yield numbers over a range of from 11 to 66.

All three dice as above described are employed in the basic game, but only the numerical (second and third) dice are used in the master's game.

In lieu of the use of dice as an alphanumeric generator, any other suitable means may be employed, as for example a spinner assembly whose needle is manually spun to provide suitable alphanumeric, or numeric readings. Such a spinner may be comprised of a needle mounted for free spinning rotation on a board, the face of the board having designated thereon the appropriate numbers at points along a circle under the needle, and with the "B" or "P" designations being similarly indicated in an additional concentric circle on the face of the board.

Alternatively, the appropriate alphabetic and/or numeric designations may be generated via a random generator computer program providing as an output a randomly generated number for the master's game, and a randomly generated letter and a pair of numbers for the basic game.

FIGS. 1*a* and 1*b* show a "key" used for interpretation of the shorthand designations used on the various game cards hereinafter described, to represent correspondingly defined play events. Since the shorthand designations set forth in FIG. 1*a* and FIG. 1*b* are repetitively used in the course of playing the baseball game, continued use of the game will result in the game player's readily committing the shorthand designations to memory. Accordingly, the text of FIGS. 1*a* and 1*b* may suitably be set out on the inside cover of a box containing the game elements, or alternatively may be provided in the form of separate sheets or cards which may be resorted to in identifying the specific play events designated by the shorthand symbols.

FIG. 1*a* under the heading "ALL GROUND BALLS" comprises a series of shorthand designations 10 for play events and corresponding definitions thereof. For example "gL" refers to a groundout by the batter, except if a runner is on first base, in which case event the event is treated as "gT" according to which if the runner is forced at second base, then the batter and runner both are out, i.e., a double play occurs, and other runners advance, i.e., a runner at second proceeds to third, and a runner at third proceeds to homeplate. If, however, no runner is forced, i.e., at the time the ball it hit, no runner is at first base, the batter is out and runners hold. Thus, the ground ball events 10 include alternative contingencies depending on the position of existing base runners at the time of the play.

A separate set of play events 12 is contained under the heading "IF INFIELD "IN"". Playing "in" may be elected by the fielding team , in which event the ground ball symbols designate the play events specified under such "IF INFIELD "IN"" heading.

FIG. 1*b* is the corresponding key for fly ball play events 13, under the heading "FLY BALLS," with an indication that the batter in such event is always out. In the section 14 headed "OUT SYMBOLS", are a series of symbols designating the various out modes, together with the asterisk designations which are utilized on the other play cards to indicate advancement by runners in hitting situations. Finally, at the lower portion of the key in FIG. 1*b* there are set out a series of shorthand designations 15 for the various player positions.

The home park card(s) utilized in the game are provided as a single card or, preferably as a set of cards corresponding to and identified by the names of major league baseball parks. An illustrative home park card is shown in FIG. 2, on the face of which San Francisco Candlestick Park is designated as the major league playing field.

Referring to FIG. 2, the home park card has set out thereon a series of numerical designations 20, ranging in value from 1 to 64, such numerical designations corresponding to numbers set forth on the player cards, as hereinafter more fully described. Associated with each number is a corresponding play event, or set of play events. When two play events are designated, each event has a numerical range associated therewith, comprising a portion of the numerical range 1–9. For example, for the number 1 on the home park card of FIG. 2, two events are alternatively specified—a single is designated for number 1, while a fly to center field, runners hold, is designated for numbers 2–9. These numbers in the range of 1–9 are determined by the play-action card, as hereinafter more fully described. Thus, when faced with alternative play events, a play action card is drawn to resolve the choice, by the number set forth on the drawn play action card, under the heading "PARK".

At the lower portion of the illustrative park card in FIG. 2, under the heading "FOUL (F)", is a listing of foul events, numbered 1–9, of which 1 and 2 denote foulouts to the catcher, while the remainder, numbered 3–9, denote fouls which count as strikes in the event that the "count" on the batter is less than "full" ; alternatively, if the count is full, the foul does not alter the count.

The game includes a set of player cards, e.g., one for each major league ball player, as a roster of available ball players, from which ball players for the game may be selected. In this manner the individual game player has a choice as to his lineup, pitcher(s), and substitutions. The game player may thus "platoon" his ball players in a manner similar to that employed by real-life baseball managers who juggle their lineups depending on opposing pitchers, insert defensive players in later innings to preserve leads over the opposing other team, and the like.

An illustrative batter/fielder player card is shown on FIG. 3, on which the ball player's name 26 is indicated at the upper left hand corner of the card. Below the ball player's name is his associated team. To the right of the ball player's name is a heading denoted "Run" following which is set forth a number in the range of 1–6, which represents the relative run production rate of such ball player. This numerical rating by comparison to the number under the heading "Running" on the play action card, as described hereinafter, permits the same player to determine whether the ball player represented by the batter/fielder card has scored a run in a given game situation.

In the upper portion of this player card, at its right hand corner, is a heading "Steal" following which are indicated a frequency of stealing, "good", "average" or "poor", and the relative frequency with which a given player, faced with a potential stealing situation, may attempt to steal the next base. Following the frequency designation is a number in the range of 1–9 which indicates the stealing success rate of the given player, i.e., regardless of his frequency, when a player does attempt to steal a base, whether he is relatively successful or not. Numerical values at the lower end of the steal rate, i.e., 1–4, denote a poor success rate in stealing, values of 6–9 indicates good success, and a value of 5 indicates mediocre stealing ability.

Below the aforementioned headings, are set out the headings "Bunt" and "Hit-And-Run", for each of which the specific ball player's performance is designated as "good", "average" or "poor". These quality designations are in turn used on the play-action cards hereinafter described to specify play events depending on whether the ball player's card indicates the given bunt, or hit-and-run ability as good, average or poor.

Finally, the heading "Injury" is followed by a numerical designation in the range of from 1–20, which indicates the injury rate for the given ball player. Such injury value is utilized in various events on the play-action card, some of the outcomes of which indicate injury of a ball player. A multiplier on the play action card then is multiplied by the injury rate on the ball player's card, to yield a number of games or innings which the ball player is not able to play. This feature simulates injury situations occurring in a real-life game, and when occurring, forces the game player to substitute for the injured ball player.

Below the upper section 26 on the ball player's card is a fielding/throwing section 28, in which each of the possible defensive playing positions for the given ball player is set forth. For example, for the ball player card shown in FIG. 3, the designated ball player is able to play right or left field, third base, or shortstop, reflecting the real-life playing capacities of the specific major league baseball player. For each of these playing positions, there is set forth a number in the range of from 1–5, values of 1–2 representing above average fielding ability, a value of 3 representing average fielding ability, and values of 4–5 representing below average fielding ability of the ball player at such playing position. These fielding range ratings 29 are utilized in connection with corresponding play events on the play action cards, as described hereinafter.

If the specific ball player is an outfielder, following the fielding range rating 29 is a superscript designation 30 for the throwing arm rating of the outfielder. Thus, for the ball player card in FIG. 3, the throwing arm rating 30 of the player in the right or left field positions is designated as $-3$. The specific throwing arm values are utilized in connection with play events identified on the play-action card, as hereafter described.

Following such fielding rating(s) is a designation of error frequency 31, identified by the symbol "e" followed by a number indicating the error frequency of the ball player at such position, i.e., the frequency at which such ball player commits an error while playing the identified position. This number is used in conjunction with play events on the play-action card, as the basis for a determination of whether with a error frequency exceeds, is less than, or is equal to, an error number on the play action card. If the error number specified on the ballplayer card is less than or equal to the error number identified on the play action card in a specific instance, the ball player has not committed an error. Conversely, if the "error number" on the ball player card exceeds the error number on the play action card for such position, the ball player has committed an error, with the consequences specified on the play action card.

Section 28 of the ball player card also contains a designation for the infielders of double play rate, i.e., the rate at which such ball player may be anticipated to initiate a double play when appropriate runner(s) are on base and the ball player at such position makes a play on a ball hit by the batter. The symbol for such double play rate is "$DP^x$", where x is a number which is compared with a corresponding number on the play action card, to provide a play outcome.

The section 34 of the ball player card comprises a left-hand column 35 with the heading "left-hand pitcher" and right-hand column 36 with the heading "right-hand pitcher," in which various play events are set out for each of the numbers 11–66 which are specified by the random number generator, such as the conventional 6-faced dice described hereinabove. The respective headings of columns 35 and 36 may include a specification of the batter's actual batting average against left-handed and right-handed pitching, respectively. The play events specified in the respective columns 35 and 36 may be directly specified, such as by "K" representing a strikeout or similiar hit designation, or the number may designate a reference to the park card as in the case of number 31, which specifies the park card and number 3. Thus, the generation of number 31 as the numerical determinant for the play directs one to the park card (FIG. 2) under the number 3, which specifies alternative single and fly ball outcomes as associated with respective numerical values 1–4 (single), and numerical values 5–9 (a fly ball to center field with runners, if any, holding on base). Accordingly, this alternative outcome designation would in turn dictate that the game player select a play action card to determine the number under the heading "PARK" to identify the outcome event from among the two alternatives specified on the home park card.

Alternatively, the ball player's card may indicate outcome events specified on the play action card directly without reference to the home park card. For example, if the ball player is batting against left-handed pitching, and the number 56 is generated as indicating the play event on the ball player's card shown in FIG. 3, the resulting "Play-X" designation refers to the event(s) specified on the play action card under the heading "Play-X". Other designations which may determine play outcomes specified on the play action cards include "Action" for which there is a corresponding designation on the play action card, and the designation "play (Y)" in which "Y" refers to a specific position, thereby designating that the ball player at such position is presented with a fielding opportunity. In such case the play action card is referred to for the position specified and an event is thereby determined, based on the fielding range specified on the ball player card of the ball player at such fielding position.

A further alternative outcome is indicated by the number 42 in each of the left and right-hand columns 35 and 36, respectively, the corresponding play event being designated as "Pitch-44". Such designation indicates that the play event is specified on the pitcher's card for number 44, and the pitcher's card may in turn specify the outcome or refer to the park card for the ultimate outcome play event.

An illustrative pitcher's card is shown in FIG. 4. At the upper left-hand corner of this card, the player's name 40 is specified with his team affiliation 42, and his "tired" ratings 43. For the specific pitcher identified, tired ratings are identified for both starting pitcher and relief pitcher, such ratings being numerically indicated. For example, the tired ratings 43 shown in FIG. 4 indicate that the starter will be in a "tired" state after 8 innings, and that in a relief role he will not be used at all.

On the upper right hand side of the pitcher's card, there are indicated a respective injury designation 44, runner "holding" ability 45 and balks frequency 46, each of such designations being followed by a number indicating the pitcher's relative ability in such category. The numerical range for each of these categories is from −2 to +2 for holding the runner, from 1 to 20 for injury, and I to VI for balks, and these ratings are utilized in specifying outcomes on the play action card, as hereinafter described.

The upper right-hand portion of the pitcher's card also contains the pitcher's range and error ratings 47 and control rating 47*a* after the heading "pitcher". A number indicating the pitcher's relative range, in the range of from 1–5, is utilized in specifying outcomes on the play action cards. The range rating number is followed by the error designation "eW", where "W" is a number designating the error rate of the pitcher, i.e., the relative frequency with which the pitcher commits errors when presented with a fielding opportunity.

The pitcher's card contains alternatively applicable number-event listings in columns 50 and 52, column 50 specifying outcomes when the bases are empty, and column 52 specifying outcomes with runner(s) on base. The headings of these respective columns may also contain the batting averages of batters opposing such pitcher in the respective bases empty, and runners on base, circumstances.

In each of the respective columns 50 and 52 is a listing of numbers in the range of 11–66 as determinable by the random number generator, e.g., six-faced dice, previously described. Each of these numbers designates a play outcome either directly, or indirectly, such as by reference to a park card, e.g., "Park-7" for the number 53, which then directs the game player to the home park card for the outcome specified thereon for number 7. As previously indicated, such number may, as on the sample home park card shown in FIG. 2, specify alternative outcomes, which then would be determined by selection of a play action card and identification therefrom of the number under the heading "Park", as previously described. Alternatively, the outcome specified on the pitcher's card may identify a play by a fielder, such as is the case for number 11 in column 50, which identifies the outcome as a play by the shortstop. In this circumstance, one would resort to the play action card and the shortstop's batter/fielder card determining the fielding rating of the shortstop from the batter/fielder card and with such rating selecting the corresponding outcome on the play action card for the specified fielding ability of the shortstop.

Respective sides of an illustrated play action card are shown in FIGS. 5*a* and 5*b*. Although the drawings illustrate the text on opposite sides of a playing card, it will be appreciated that the entire text shown in FIGS. 5*a* and 5*b* may be consolidated onto a single face of a playing card, if desired. The ensuing description, however, will treat the play action card as a two-faced card having the respective textual portions shown in FIGS. 5*a* and 5*b* on its respective front and back faces.

The front face of the play action card as shown in FIG. 5*a* identifies the play action card by the legend 60, "PLAY-CHANCES". Under this legend is a first column 62 with the heading "POSITION", in which each of the player positions is identified. Five columns 64, respectively numbered 1–5, appear to the right of the first column 62. These numbered columns 64 specify fielding range values for each of the listed positions, and for each of such fielding range values a corresponding outcome. Accordingly, if the ball player card, either the batter/fielder card (FIG. 3) or the pitcher card (FIG. 4), specifies a play at a given defensive fielding position, the game player looks to that ball player position on the play action card under column 62, and at the outcome in the appropriate numbered column corresponding to the specific fielder's fielding range rating. In some instance, the ball player position in column 62 will indicate an error rating number, which then is compared with the error frequency rating of the specific fielder to determine if an error has in fact taken place, i.e., if the error rating number on the play action card is greater than the fielder's error frequency rating. If an error has occurred, one looks to the outcomes of the error as identified on the lower portion of the front face of the next play action card, in section 67 for infield errors and section 68 for outfield errors, as applicable.

If, on the other hand, the error rating specified on the defensive ball player's card is less than the numerical value specified as the error value in column 62, then no error has occurred, and the outcome is as specified under columns 64 for the specific fielding range value identified with that ball player, as determined from the defensive ball player's batter/fielder card.

It will be noted that for some of the play outcomes listed under columns 64, the hit designations are suffixed by asterisk symbols, which identify the advancement of any runners who may be on base at the time of such hit. These further outcomes are specified with reference to the key shown in FIG. 1*b*. For example, a single asterisk indicates that any runners on base each advance one base, a double asterisk two bases, and a triple asterisk three bases.

Referring again to the play action card shown in FIG. 5*a*, there are set out at the bottom portion thereof respective infield and outfield error contingencies, which as shown may further specify runner behavior for base runners at the time of the error. For example, for the outfield error description 68, a two base error is indicated, as result of which the runners score, and the batter may try for third against the outfielder, for whom a throw rating is parenthetically indicated. It is to be noted that this is an equivalent event to stealing a base, i.e., a runner choosing to advance "against" the outfielder's arm. In such event, the runner's numerical run rating is located on his player card, and to such number is added or subtracted (depending on the "+" or "−" sign prefixed thereto) first, the fielder's throwing arm rating and then the applicable number indicated by the play action card. The next play action card then is drawn and its "Running" action referred to for the outcome.

On the reverse side of the play action card, illustratively shown in FIG. 5*b*, a variety of outcomes is specified for various event catagories, such as "Bunt", "Hit-And-Run", "Double Steal", etc.

The event categories identified on the play action card on its reverse side (FIG. 5*b*) are either specified on the batter/fielder card or else determined independently by the game player representing the pitcher or batter, as strategy choices declared by the game player.

The outcomes on the play action card may be initially specified on the player's card, by headings such as "Play-X", or "Action", in which case the play action card is selected and the outcome under such heading is the outcome event. In some instances, however, a further determination may be required, such as under the heading "Action" on the card shown in FIG. 5*b*, where alternative outcomes are specified for the respective numerical ranges 11–16, and 21–66. In such circumstances, the game player will again roll the dice or otherwise determine a randomly-generated number in the range of 11–66 and will on the basis of such number identify the outcome event set out on the play action card.

At the bottom of the play action card, under the "pitcher tired" heading 80, which as a convention of the game only applies if a man is on base, is set forth an outcome event which is determined as the play event when the pitcher tired designation is generated as a status, upon rolling of the aforementioned die containing the "$P_T$" symbol or otherwise by generating an alphanumeric or other designation from which play events are determined.

The reverse side of the play action card also indicates a number of strategy designations which may be chosen by the game player representing a runner, including designations of "Running" 82, "Steal 2B" 83, "Steal 3B" 84, "Steal Home" 85, "Bunt" 86, "Hit-And-Running" 87, and "Double Steal" 88. For each of these categories 82–88, there is presented an outcome either as an event or as a set of alternative events, or as a numerical designation which is compared with corresponding numerical ratings of the player to determine whether the event has been successfully accomplished.

For example, each batter/fielder player card has a run rating, and if in a given play situation, a runner elects to take an extra base, as opposed to "holding" his base, a play action card is selected, and the running numerical designation is compared with the run rating on the batter/fielder card of such base runner. If the base runner's run rating number is equal to or larger than the number under the "Running" heading on the play action card, the runner is successful. Conversely, if the ball player's run rating is less than the "Running" number on the drawn play action card, the runner is not successful and he is deemed to have been thrown out.

The same procedure applies to the stealing categories 83–85, in which the ball player's stealing rate is compared with the numerical value set out on the play action card for the desired base stealing attempt, i.e, of second base, third base, or home. In some instances, the base stealing attempt may simply be deemed an out, such as for the third base stealing attempt under heading 84. For some stealing situations, the play action card will identify alternative outcomes, such as the home stealing attempt under heading 85, where the outcome is different depending on the play circumstances specified.

For bunting and hit-and-run situations, the outcome may be directly specified, as under the bunt heading 86 in FIG. 5*b*, specifying a ground ball to the first baseman, with the runners advancing, except if the infield is "in" (this is also a matter of choice by the fielding team, whose game player simply declares that he is pulling the infield in), and in this case the lead runner is out, the batter safe, and other runners advance.

Alternatively, the outcome may be specified in terms of "good", "average" and "poor" specifications for the specific ball player, as set out on his player card, such as shown under the "Hit-And-Run" heading 87, in which a "good" designation on the ball player's card gives the outcome of a ground ball to the second baseman, with the runners advancing for a "poor" designation, the outcome is that the batter misses the pitch, and the runner must steal, the parenthetical number −1 indicating that the runner's stealing rating has reduced by 1. Such diminution of the stealing rating then becomes a possible factor as the next play action card is drawn and the stealing outcome resolved-if the stealing outcome is specified numerically, the base steal rating, diminished by 1, is compared with the numerical value given to determine the outcome. If the stealing outcome is directly specified, then the diminution of the stealing ranking does not enter into the determination of the outcome. The catcher's throwing arm rating is always a factor in the outcome determination for any steal attempt which is not an attempted steal of home plate or a pick-off attempt.

Under "double steal" heading 88, alternative outcomes are specified for the numerical ranges 11–16 and 21–66, indicating that the game player must roll the dice again to determine a number that will specify one of these outcomes. If such number generated on re-rolling the dice is from 11–16, the outcome is that the batter misses the baseline coach's signal of the steal attempt to him, and the batter thereupon bunts, in which case the outcome is specified by the result under the "Bunting" heading 86 on the next play action card. If, on the other hand, the number generated is from 21–66, the pitch to the batter is a ball, the trailing base runner steals against the catcher, with the catcher's throwing arm numerical rating diminished by 1 and compared to the stealing rating number for the base runner, and the lead runner steals against the second baseman, with the second baseman's fielding being diminished or increased depending on the numerical value of his rating. For example, if the second baseman has a fielding range of 2, then such value is simply compared with the stealing rate of the base runner; if the second baseman s fielding rate is 4, then it is effectively increased to 6 for purposes of comparison with the base runner's stealing rate. Thus, if the so-adjusted fielding range for the second baseman is equal to or greater than the stealing rate for the base runner, the base runner is thrown out by the second baseman. Conversely, if the adjusted fielding rate is less than the stealing rate for the base runner, the base runner is deemed to have successfully stolen the subsequent base. It is to be noted that the lead runner in this instance is attempting to steal home plate against the second baseman. To determine the outcome, the runner's steal rating, from 1 to 9, is determined, and to this number is added or subtracted, depending on its "+" or "−" designation, the second baseman's range rate.

The reverse side of the play action card also includes a "Take" heading 89, which indicates that the batter takes the pitch, i.e., does not swing. In such case the outcome is as specified. In the illustration card of, FIG. 5*b*, the outcome depends on whether there is a runner on base and his steal frequency is good. If such criteria are met, the pitch is a ball; otherwise, the pitch is a strike.

The game player representing the pitcher, by declaration to the opposing game player, may likewise choose certain pitching strategies, as indicated under the "Hold" heading 90 and the "Pick-Off" heading 91. Accordingly, prior to making a pitch to the batter, the game player may declare his intention to hold any runner on base. The "Hold" event on the play action card shown in FIG. 5*b* specifies a diminution of the pitcher's otherwise applicable hold rating. Referring to pitcher's card shown in FIG. 4, the hold rating is 0, so that as diminished by the value set forth on the play action card of FIG. 5*b*, the pitcher has an effective hold rating of −1, which is compared with the stealing rate for the base runner if such base runner attempts to steal (this is indicated by simple declaration of the offensive game player to the fielding game player). Thus, when a steal is attempted by the base runner, the steal rate is compared to the hold value, as adjusted, to determine whether the stealing attempt is successful.

In like manner, when the offensive team's game player declares that a base runner is taking a lead, the pitcher thereupon may declare his intention to hold the runner on base. In such event, a play action card is drawn and the outcome specified under the "Pick-Off" heading 91 is determined. In the outcome specified on the illustrative card shown in FIG. 5*b*, a pick off will result in the base runner being trapped off base and having to steal against the pitcher, whereupon the pitcher's hold rating, as determined from the pitching card (FIG. 4) is diminished by 1 to yield an effective hold value, which then is compared against the stealing rating of the base runner to determine whether the steal attempt is in fact successful. In this situation, the catcher's arm is not a factor. In such instance, any other base runners may try to advance against the basemen (fielders) for the bases which such base runners formerly held; in such event, the fielder's throw rating is increased or diminished according to the numerical values given for his particular fielding rating, and numerically compared against the running rating of the base runner, to determine if the attempt to advance is successful, with reference to the "Running" section of the play action card which then is drawn.

In the basic game, the aforementioned home park, play action and player cards only are employed, together with the random character generator.

In the so-called Master's Game, hereinafter described in greater detail, the pitching outcome cards shown in FIGS. 6–8 are employed. As shown in FIG. 6, one of such cards simply contains the designation "CURVE BALL" on its face. A second card, shown in FIG. 7, identifies the pitch as a "FAST BALL", and contains the additional specification that if the pitcher is "tired", as e.g. indicated by the "$P_T$" faced die, and the batter guesses wrong for the pitch, then a playaction card is drawn for the "pitcher tired" result. The third pitching outcome card, shown in FIG. 8, identifies the pitching outcome as a "PITCH OUT (BALL)", and presents various contingent outcomes depending on the circumstances at the time of such pitch. These contingent outcomes are as follows:

If the batter guesses a fast ball or a curve ball, or the batter takes a pitch, then the pitch is a ball.

If a stealing play is attempted by the at-bat team, the runner steals, subject to a diminution of his stealing rating by 1.

If a double steal is attempted, the trailing runner is safe, and the catcher tries to pick off the lead runner, subject to a diminution of the catcher's throwing arm rating by 1.

If a bunt is declared by the game player representing the batting team, the catcher attempts to pick off the lead runner, with a diminution of the runner's run rating by 1, and with all other runners holding.

If a hit-and-run is declared by the game player representing the at-bat team, the lead base runner must steal, with a diminution of his steal rating by 1. Other runners correspondingly advance.

PLAY OF THE RESPECTIVE BASIC AND MASTER'S GAMES

In both the basic and master's games, each of the players identified on the player cards preferably will perform according to his real-life ability, in accordance with his statistics in each category reflected in the game of this invention. The game player functions as an owner-manager, with the opportunity to determine strategy and make tactical decisions in the context of decisions made by the opposing game player.

The play events reflected on the player cards and park cards are thus suitably historically researched, to reflect statistical accuracy for the ball players and parks, relative to performances of a preceding or recent major league baseball season. Accordingly, it is contemplated that over a course of time, player cards and park cards may be replaced or up-dated to reflect the performance history associated with such ball players and playing fields.

It is also within the purview of the invention to utilize entirely fictitious park names and ball players, as well as ball players of various eras, e.g., to formulate playing teams for a hypothetical "old-timers game" or a game played by major league players who have been elected to the Baseball Hall of Fame.

The so-called "basic game" is suitably played with three dice, as previously described, or with any other random character generator generating the "P" and "B" designations, as well a numbers in the range of from 11 to 66. The basic game may typically take on the order of from about 15 to about 30 minutes to play, whereas the master's game, using the three"pitch" cards hereinabove described, and two numbered dice, may require on the order of from about 45 to about 60 minutes to complete a typical game.

Each of the home park cards as previously described depicts an actual distribution of hits at the designated major league park. The game is constructed so that approximately 20% of all play results are influenced, i.e., determined directly or indirectly, by the home park card.

As previously described, each batter/fielder card comprises a number of play results which are tabulated in terms of the specific ball player's performance against left-handed and right-handed pitching. Each pitcher's card is separately tabulated with play results for bases empty situations, and play situations where runners are on base.

During the play of the basic game, results are obtained by rolling the dice and using the park, ball player, and play-action cards. Play begins when the offensive game player rolls the aforementioned three dice for his first batter. The large red die determines where the play result will be found. A result of "B" on the red dye indicates the play result will be found on the batter's card, while a result of "P" indicates that the play event will be determined by the pitcher's card.

The two white dice then are read, with the larger of the two dice determining the first digit of the two-digit number in the range of from 11 to 66, and the second, smaller die indicating the second digit of such number pair. This number then is referred to on either the pitcher's card or the batter's card, depending on which is indicated by the red die.

When the play is indicated by the red die to be on the batter's card, it first is determined if the pitcher opposing such batter is left- or right-handed. Conversely, when the play event is to be found on the pitcher's card, it is first determined if the bases are empty, or if a runner(s) is on base. As previously described, the red die contains a face having the designation "$P_l$", and this result is treated for purposes of reference to the ball player cards as a "P" designation, indicating that the play event is to be found by reference to the pitcher's card.

On the play-action cards previously described (FIGS. 5*a* and 5*b*), the fielding chances and error descriptions are on one side of the card, and possible strategy choices are on the other side thereof.

Because the baseball game is constructed to reflect real-life play of major league baseball games, some unusual and rare play events are included in possible outcomes. Sometimes a further roll of the dice is required to resolve some play situations referenced on the play-action cards. In addition to reflecting possible outcomes for strategy choices, the play action cards are used to determine outcomes for the "PLAY-X " and "ACTION" results found on the batter cards.

The baseball game uses the number system of 1–9 to resolve all base-running and stealing situations. The same number system is employed to resolve results on the home park card when alternative play events, each associated with a sub-range of numbers within a broad range of 1–9, are set forth.

The home park cards are a vital element of the baseball game. When the result "PARK" is indicated on either the batter's or pitcher's card by the number thrown on the dice, the number indicated is found on the home park card and the result of the play associated with such number. Occasionally, one will need to draw a play action card to resolve a play found on the home park card. In this event, the park number found on the upper left corner of the play action card, on the reverse side thereof (FIG. 5*b*) is referred to. After the play outcome is determined from the play action card, the play action card is discarded, e.g., returned to the bottom of the stack of play action cards. Each home park card is different and is statistically constructed to influence ballgames in the same way that the real-life home parks do for major league baseball players. This is due to the fact that each home park card portrays the actual historical distribution of hits at the corresponding real-life baseball park.

The fielding capabilities of the baseball players who are in the field during play of the game figure importantly in the outcomes. As previously indicated in connection with the ball player cards, each major league baseball player is rated separately for range and error frequency. Outfielders and catchers are also rated for the effectiveness of their throwing arms. Pitchers are rated for their ability to hold runners on base, for balks, and for control.

When the result indicated on either the pitcher's or batter's card is "PLAY(Q)," "Q" represents the playing (fielding) position of the baseball player presented with a fielding opportunity (e.g., refer to FIG. 4, in which number 11, in both columns, represents a play at the short stop). In other words, such a result indicates a fielding chance for the player whose position is parenthetically indicated. In this event, the fielding player's card is referred to for his rating at his fielding position. All players are rated on a scale of from 1 to 5, 1 indicating excellent fielding capability and 5 indicating poor fielding ability. After the fielding player's rating is determined, the top card is drawn from the play-action deck and referred to on the play-chance side of the card (FIG. 5*a*), referring to the column on the left hand side for the player position of the fielder. To the right of the position designation are five numbered columns, each having a number of from 1 to 5 associated therewith, corresponding to the fielding range. The column is selected with the specific fielding player's range rating, to determine the play result.

Sometimes, the fielding players position on the play action card which is drawn, will have a reading of "e" followed by a number, and this designation indicates a possible "error" situation. In this situation, if the fielding player's error number (located next to his range rating on his batter's card) is equal to or greater than the error number on the play-action card, then the fielding player is deemed to have made an error on the play. The play action card indicating the occurrence of such error then is discarded, and the next play-action card in the deck is selected for the appropiate infield or outfield error description (such as is shown in FIG. 5*a*, in sections 66 and 68 of the card).

If, on the other hand, the fielding player's error rate is less than the "e" number shown on the play-action card, the result will be found in the column corresponding to that player's range rate.

The game is constructed to reflect the possibility of defensive double plays, and for this purpose, third basemen, shortstops, and second basemen are rated with double-play (DP) rates. This rating system realistically reflects the real-life players' individual fielding abilities.

During play of the game, the fielding players position on the play-action card will sometimes be followed by a reading of "DP-W", where "W" is a number used as a comparison basis, e.g., "DP-1", similar to the error ratings. Thus, if the infielder DP rating is equal to or greater than the DP result on the play-action card, the result is treated as a ground ball to such player, in which any lead runner is forced out, the batter is safe, and any other runners advance, such result in the symbology of the game being represented as "G(Q)T", where "Q" is the fielding position of the defensive player, and gT has the meaning ordinarily associated with such symbol (see FIG. 1*a*). If, on the other hand, the defensive player's DP rate is less than the DP rate on the play-action card, the result is found in the column on the front face of the play action card, under the numbered column corresponding to that player's range rating.

Whenever a hit or a hit symbol is followed by an outfield position in parentheses, any runner may try for one extra base against the outfielder. Such attempt is indicated by a declaration of the offensive game player to the opposing fielding game player. If the offensive game player declares his intent to make such extra base attempt, the base runner's run rate, as determined from his player's card, is combined with the outfielder arm rating to obtain the runner's "adjusted run rate". The top card then is drawn from the play action card deck and referred to in the section marked "Running" (section 82 in FIG. 5*b*). If the runner's adjusted run rate is equal to or greater than the number on the play-action card, the runner is safe, and the batter and other runners advance one extra base. If, however, the runner's adjusted run rate is less than the number shown on the play action card under the "Running" heading, the runner is out, and the batter and other runners advance one extra base.

In this circumstance, the defensive game player may concede the extra base to the runner and thus hold the batter to his hit, and keep the other runners from advancing the extra base. The "Running" section of the play-action cards is used for all running situations that are not steal attempts.

In order to attempt and possibly obtain a stolen base, the offensive game player must announce to the opposing defensive game player that a runner is "taking a lead" before an attempt is made to steal a base. As in real-life play, the defensive game player, when the runner takes such a lead, has an opportunity to utilize his pitcher to "hold" the runner on base.

To "hold" the runner who has taken a lead, the defensive game player simply states his intention to "hold" the runner, and draws the top card in the play action card deck, referring to the section headed "Hold" (section 90 in FIG. 5*b*). Holding a runner will always reduce the runner's chance of stealing safely, unless there is a balk by the pitcher, or an error occurs. The effect of holding a good stealer on base will be less than the effect of holding an average or poor stealer.

The steal attempt is resolved as to outcome in the following manner. The number following the player's steal frequency rate is that player's "steal number", which as previously described indicates the success rate of the player when a steal is in fact attempted, while the steal frequency rate is merely an indication of the relative frequency with which such attempts are made. The outcome is calculated by adding the pitcher's hold rate, the catcher's throwing arm rate, and the number indicated by the "Hold" category on the play action card, the "Hold" heading indicating a parenthetical number which is either added or subtracted, depending on the presence or absence of a minus sign prefixed to the number, and the runner's adjusted steal rate is determined as the numerical result. In other words, the adjusted steal rate is determined for the runner as follows: Runner's adjusted steal rate = runner's steal number + pitcher's hold rate + catcher's arm + hold rate from play action card.

The top card then is drawn from the play action card deck, and the section entitled "Steal (B)" is referred to, in which "B" represents the base which is attempted to be stolen. The play action card may have an outcome, such as the third base section 84 on the play action card shown in FIG. 5*b*, in which the runner attempting the steal is thrown out. Alternatively, the outcome may be numerically determined, as under heading 85 on the play action card of FIG. 5*b*. If the play action card indicates a number, the same is compared with the runner's adjusted steal number, calculated by the algorithm set forth above. If the runner's adjusted steal number is equal to or greater than the number on the play action card, the runner is deemed safe. If, however, the runner's adjusted steal number is less than the number on the play action card, under the appropriate steal heading, the steal is unsuccessful and the runner is out.

In response to some strategy choice made by the offensive game player, the defensive game players in the field may elect to "pick-off" the runner on base. In this game, the pick-off play always results from some other offensive strategy choice, such as the decision by the offensive game player to "take a lead", as previously described. Since the pick-off play always results from some strategy choice, the defensive game player may not "call" for a pick-off play. The "Running" section of the play action card is employed to resolve a pick-off play, unless the base runner is forced to steal the next base, as more fully described hereinafter.

To initiate a bunt attempt, the offensive game player declares his intention to do so and draws the top play action card in the play action card deck, referring to the section of the card under the heading "Bunt". This same section is utilized regardless of the bunt type, e.g., sacrifice bunt, squeeze bunt, and bunting for a hit. If the infield is playing "in", this greatly reduces the chances of a successful bunt attempt.

To effect a hit-and-run play, the lead runner must "take a lead", as in the situation previously described for base stealing attempts. To attempt this play, the offensive game player declares his intention to do so, to the opposing defensive game player, and draws the top play-action card in the deck referring to the section marked "Hit-And-Run". If the infield is playing "in", this increases the batter's chance of getting a hit if this play is called. The hit-and-run play also reduces the chance of double-play. Choosing the hit-and-run play in the above-described manner will not affect a player's batting average, but he will hit for less power than otherwise would be the case.

Double-stealing situations are of two types in the play of this game. The first type occurs when runners are on consecutive bases, e.g., first and second base, or second and third base. In this consecutive base runners situation, if the offensive game player desires to attempt a double steal, he states his intention to do so to the opposing defensive game player. As in other steal situations, the leading base runner must "take a lead" before attempting to steal. The defensive game player then faces a choice of which runner he will attempt to throw out. At this point, the defensive game player draws the top play-action card in the play action card deck and refers to the base where he chooses to make the play on the runner.

The other type of double steal is attempted only when base runners are on first and third bases. To initiate this double steal attempt, the offensive game player states his intention to do so to the opposing defensive game player. The defensive game player then may choose to concede second base to the trailing runner, thereby holding the runner who is already at third base. If the defensive game player chooses to challenge the play, he then draws the top play action card from the play action card deck and refers to the section headed double steal (section 88 in FIG. 5*b*).

At any time during the playing of the baseball game, a defensive game player may choose to play the third baseman "in", the first baseman "in", or both fielders "in". Placing the first and/or third baseman in such position decreases the chance of a successful bunt, or a runner scoring from third base. Conversely, playing the infield "in" increases the batter's chance of getting a hit. For example, many play results on "Play-X" that normally would be "outs" become base hits when the infield is "in". As an example, see the section under the heading "Play-X" on the play action card illustratively shown in FIG. 5*b*. Under this heading, the play outcome is a ground ball to second base with the runners advancing if the fielders are not in. However, as indicated parenthetically, if any fielder is in, the outcome is a single (one base hit).

Set forth below in summary form is a tabulation listing of the various player ratings.

PLAYER RATINGS

Offensive Ratings:
Running Rate: 1–9 (9 is excellent)
Steal Rate: 1–9 (9 is excellent)
Steal Frequency: Good, Average, Poor
Bunt Rate: Good, Average, Poor
Hit-And-Run: Good, Average, Poor
Injury Rate: 0–20
Defensive Ratings:
Fielding Range: 1–5 (1 is excellent)
Error Frequency: 0–25 (variable by position)
Throwing Arm: −3 to +2 (for outfielders and catchers only)
Double Play Rate: DP-1 to DP-3 (for third-basemen, shortstops, and second-baseman only)
Hold Rate: −2 to +2 (for pitchers only)
Pitcher Tired ($P_t$) Ratings:
Each pitcher has a "tired" rating following his starter or reliever designation. When a pitcher is in the designated inning, or in a later inning, and a runner is on base, then the pitcher is deemed to be "tired". In such such circumstance, a player rolling a "$P_t$" on the red die, then draws the top card from the play action card deck and refers to the section of the play action card marked "Pitcher Tired" (section 80 in FIG. 5*b*).
Power Ratings:
Each batter has a power rating against both left-handed and right-handed pitching. If a batter is rated for "power", he achieves the home run results shown on the pitcher's card. If a batter is rated for "no power", home run results on the pitcher's card count as singles (one base hits).

As a further feature of the game, some of the batter cards also have an entry in the list of possible outcomes, "PITCH-44", which when indicated, refers the game players to the pitcher's card under number 44 for the play outcome, which will be either a home run, a park-home run number, or an out. In this manner, pitchers who rarely give up home runs will perform just as in real life performance. A batter can always get the "Pitch-44" result on his own playing card even if he is rated for "No Power". To simulate the real-life tendency of players to be injured on occasion, each player has an individual injury rating.

When the player is injured, his injury factor from his players card is multiplied by the number indicated on the play-action card, to yield the number of innings or games which subsequently will be missed by the player due to such injury. In this event, the injured player will be substituted for, as in real-life play.

Some outcomes on stealing plays, and on hit-and-run plays, are arranged such that an offensive game player can gain an advantage by "working the count". To do this, the offensive game player declares to the opposing defensive game player his intention to work the count and draws the top card from the play action deck, referring to the section marked "Take" (section 89 in FIG. 5*b*) for the result of the pitch. In this manner, the game players can play on a pitch-by-pitch basis in certain situations of the basic game. To gain an advantage by working the count, the player must extend the count of balls and strikes to 3–2, 3–1, 3–0, 2–1, or 2–0, in which the first number is the number is the number of balls and the second number is the number of strikes accumulated by the batter.

When a pitch is taken by the batter, the pitcher's control rating is the most important determinative factor. Pitchers are numerically rated for control by a number in the range of 1–5, with 1 denoting great control and with 5 indicating poor control.

With the foregoing procedural aspects of the game established, play is commenced by each game player selecting an individual baseball player for each of the nine team positions, and making up a batting order, placing the nine player cards one on top of the other so that the cards are in sequence, with the lead-off batter on top. It is to be noted that each ball player's position and fielding rating is found on his card under the specific individual player's name. A ball player may play only a position which is listed on his card, as reflecting the real-life playing capabilities of the named baseball player.

After each of the ball players is selected for the specific contest, it is decided, such as by a coin flip or other random selection means, or by agreement, which team will be the home team, such choice in turn determining the home park card which will be used in playing the game. The home park card is then placed in a position where both game players can see it clearly.

Next, the deck of play action cards is shuffled and positioned beside the home park card, with the fielding-chances faces of the play action cards in the upwardly facing position, so that the front faces in such stack correspond to FIG. 5*a* and the back sides of such cards correspond to FIG. 5*b*.

Next, in accordance with the rules of protocol prevailing in real-life baseball, the visiting team leads off as the batting side. The visiting team game player then rolls the dice for his sequential players and the action is continued until three outs are made and his side is retired, following which the other game player takes his turn in similar fashion, and in this way play is continued until nine innings are completed, or if the play is tied at the end of nine innings, then play is continued into extra innings, as in real-life play.

MASTER'S GAME

For the master's game, the players use the three pitch cards shown in FIGS. 6, 7, and 8, instead of the red die which is employed in the basic game.

Preparation for play is commenced in the same fashion as described above for the basic game, with each game player choosing a line-up of ball players and a batting order, and determing the home and visiting teams.

Play of the baseball game is commenced with the defensive game player, as the pitcher, choosing one of the three pitch cards, either the fast ball, curve, or pitch out card, and concealing his choice from his opponent by placing the selected pitch card face down near the park card.

After such selection of a pitch card by the defensive game player, the offensive game player, as the batter, then can: (a) guess what the pitch is, by declaring his guess to the opposing defensive game player; (2) take a pitch; or (3) choose a strategy.

The defensive game player then reveals the choice of pitch he has selected, by turning over the previously selected pitch card (which has been placed face down, as indicated).

Based on the choice of pitch by the defensive player and the guess made by the offensive player, the following outcomes may result:

(1) If the pitch is a pitch out, then the pitch out card is referred to for the result of the play;

(2) If the batter guesses right for either curve or fast ball, the two white dice are rolled to determine a number in the range from 11 to 66, and the result is determined on the batter's card for such number;

(3) If the batter guesses wrong for a curve or a fast ball, the two white dice are rolled to generate a number in the range from 11 to 66, and the result is determined on the pitcher's card for the number resulting from the roll of dice;

(4) If the batter "takes" a pitch and the pitch is a curve or fast ball, the top card from the play action card deck is drawn and referred to, under the "Take" section thereof, for the result of the play; or (5) If the batter chooses a strategy, and the pitch is a curve or fast ball, the top card is drawn from the play action card deck and referred to under the appropriate strategy heading on the reverse side of the card, for the result of the play.

The master's game involves greater impact on ultimate game results from the choice of strategy. For example, in the master's game, a pick-off play may be set up as a result of a choice by the defensive player for a pitch-out. In the master's game, the "take" results depend on the pitch called, whether it is a fast ball, curve, or pitch-out. "Working the count" in the masters game tends to set up "right guessing" situations for fast ball choice, as in real-life play, where a pitcher facing the batter with an extended count, must come in with a "strike" at the risk of walking the batter.

As indicated, while each of the basic game and masters game embodiments of the invention may be accurately historically based in terms of the statistics and outcomes as derived from a previous or current season's major league baseball performances, the game may also be based on fictitious players and parks, or hypothetical games may be set up in which players of different eras play against one another.

Further, while the baseball game embodiments of the invention have been described in terms of discrete physical cards for the ball player cards, home park card(s), and play-action cards, it will be appreciated that the baseball game of the invention may be embodied in computer software, to be played in the manner of a video game. Random number generator and random "B" /"P" generator subroutines may be employed with such software, to obviate the need for dice, spinners, or other separate random character generating means.

While preferred embodiments of the invention have been illustrated and described in detail, it will be appreciated that other variations, modifications and embodiments of the invention are possible, and all such variations, modifications and embodiments of the invention are therefore to be regarded as being within the spirit and scope of the invention.

What is claimed is:

1. A baseball game, comprising:

(a) a random character generator, said random character generator utilized to generate a two-digit character by independently generating each digit of the two-digit character;

(b) a park card containing:

(i) a series of characters generatable by said random character generator, and (ii) a series of corresponding play events;

(c) a set of play action cards, each having on a first side thereof:

a listing of all player positions;

a numerical range of fielding rations for each of said player positions; and a play event for each of the said fielding rations for each said player position; and on a second side thereof:

a series of category events; and a corresponding series of play events;

(d) a set of player cards, including batter/fielder and pitcher cards, each of said batter/fielder cards containing a designation of a specific player and playing position for said player, a fielding rating for said player at said position, and said player's performance as a batter against each of the pitching categories of right-handed and left-handed pitching, each said pitching category being so designated and having associated therewith:

(i) a series of two-digit characters generatable by said random character generator, and (ii) a series of corresponding play events, some of which designate outcome play events on one of said park cards and said play action cards; and each of said pitcher cards containing a designation of a specific player and indicia of his pitching performance in each of the pitching situation categories of pitching with bases empty, and pitching with runner(s) on base, each of said playing situation categories being so designated and having associated therewith:

(i) a series of two-digit characters generatable by said random character generator, and (ii) a series of corresponding play events, some of which designate outcome play events on one of said park cards and said play action cards.

2. A baseball game according to claim 1, wherein said random character generator comprises means for generating alphabetic and numeric characters, said alphabetic characters comprising alternatively generatable batter and pitcher designations.

3. A baseball game according to claim 1, wherein said park card, for each character of said series of characters generatable by said random character generator, designates either one or two play events, and when two play events are designated, each has a range of characters associated therewith, corresponding to characters further generatable by said random character generator.

4. A baseball game according to claim 1, comprising a set of home park cards, from which one card may be selected as designating the situs of the game as played.

5. A baseball game according to claim 1, wherein at least some of the player positions designated on said first side of said play action cards have associated therewith error ratings.

6. A baseball game according to claim 5, wherein each of said batter/fielder cards comprises a designation of error frequency of said specific player at his said playing position, whereby said error frequency rating may be numerically compared with said error rating when appearing on said first side of said play action card, to determine a play action outcome.

7. A baseball game according to claim 5, in which each of said pitcher cards comprises an error frequency rating for the designated pitcher, which may be compared with the error rating on said first side of said play action cards for the pitching position, to determine play action outcome events.

8. A baseball game according to claim 1, wherein said series of play events on said second side of said play action cards comprises play events associated with strategy choices which may be independently designated by a game player, the result of said designation being determinable by consulting a play action card or a player card.

9. A baseball game according to claim 1, comprising means for keeping score during the playing of said game.

10. A baseball game according to claim 1, wherein said random character generator comprises a set of dice.

11. A baseball game according to claim 1, comprising a set of pitch cards, including:

(a) a curve ball card;

(b) a fastball card; and (c) a pitchout card, denoting a series of offensive strategy conditions, and associated outcome play events, the outcome play events being determinable by consulting a play action card or a player card.

12. A baseball game according to claim 11, wherein said offensive strategy conditions comprise steal, bunt, and hit-and-run conditions.

13. A baseball game according to claim 1, wherein the performance of the pitchers and batter/fielders substantially corresponds to historical statistical performance of designated players as identified on said player cards, said designated players being current or past real-life major league baseball players.

14. A baseball game according to claim 1, comprising a key including an identification of symbols utilized on said park card, play action cards, and player cards, with their corresponding definitions, said symbols comprising designations for ground ball play events, designations for fly ball play events, designations for runners' base advancement and a plurality of out symbols.

15. A baseball game according to claim 1, wherein the play events are related to the actual historical distribution of hits at a historic baseball park.

16. A baseball game, comprising:

(a) a random character generator, said random character generator utilized to generate a two-digit character by independently generating each digit of the two-digit character;

(b) a park card containing:

(i) a series of characters generatable by said random character generator, and (ii) a series of corresponding play events;

(c) a set of play action cards, each having on a first side thereof:

a listing of all player positions;

a numerical range of fielding ratings for each of said player positions; and a play event for each of the said fielding ratings for each said player position, said first side of the play action card comprising an infield error description and an outfield error description; and on a second side thereof:

a series of category events; and a corresponding series of play events, said second side of the play action card comprising a running strategy designation, stealing strategy designations, a bunting strategy desgination, a hit-and-run strategy designation, and pitching strategy designations;

(d) a set of player cards, including batter/fielder and pitcher cards, each of said batter/fielder cards containing a designation of a specific player and playing position for said player at said position, a relative run production rate that may be compared to the running rating on the play action card, a stealing frequency and a stealing success rate, a bunt performance rating, a hit-and-run performance rating and an injury rate value, said bunt performance rating and said injury rate value being usable in events on the play action card, an indication of double play rate for players who are infielders, indications of fielding ability at possible defensive playing positions, a throwing arm rating of the player, and a designation of error frequency of said specific player at his said playing position, whereby said error frequency rating may be numerically compared with said error rating when appearing on said first side of said play action card to determine the play action outcome and said player's performance as a batter against each of the pitching categories of right-handed and left-handed pitching, each said pitching category being so desginated and having associated therewith;

(i) a series of two-digit characters generatable by said random character generator, and (ii) a series of corresponding play events, some of which designate outcome play events on one of said park cards and said play action cards; and each of said pitcher cards containing a designation of a specific player, an injury desgination, a runner holding ability designation, a balks frequency designation, a pitcher's range rating and a pitcher's error rating and indicia of his pitching performance in each of the pitching situation categories of pitching with bases empty and pitching with runner(s) on base, each of said playing situation categories being so designated and having associated therewith:

(i) a series of two-digit characters generatable by said random character generator, and (ii) a series of corresponding play events, some of which designate outcome play events on one of said park cards and said play action cards.

17. A method for playing a baseball game as described in claim 1, comprising the steps of:

(a) each game player selecting an individual baseball player card for each of nine team positions;

(b) making up a batting order;

(c) placing the nine player cards one on top of the other;

(d) determining which team will be the home team to determine a home park card;

(e) placing the home park card where it an be viewed by the game players;

(f) shuffling the play action cards;

(g) a first player generating a random character to determine whether the play result will be found on the batter's card or the pitcher's card;

(h) generating two further random characters to determine the two digits in a two digit character;

(i) using the two-digit character to determine which play result is to be followed on the batter's or pitcher's card;

(j) the first player repeating steps (g) to (i) following the instructions and information on the play aciton and player cards to determine hits, outs and scoring, until three outs have been made and a first half of a first inning is complete;

(k) a second player repeating steps (g) to (i) until a second half of the first inning is complete; and (l) the two players repeating steps (j) and (k) until nine innings are complete or until the score is not tied.

18. A method for playing a baseball game according to claim 17, further comprising a step of one player choosing a pitch card.

* * * * *

UNITED STATES PATENT AND TRADEMARK OFFICE

CERTIFICATE OF CORRECTION

PATENT NO. : 4,822,043

DATED : April 18, 1989

INVENTOR(S) : Lewis S. Carter

It is certified that error appears in the above-identified patent and that said Letters Patent is hereby corrected as shown below:

Column 3, line 42, after "the", insert --pitcher, optionally with one or two of such faces additionally--.

Column 3, line 62, change "permutation" to --permutations of--.

Column 20, line 57, change "rations" to --ratings--.

Column 20, line 59, change "rations" to --ratings--.

Column 22, line 62, after "rating", insert --, said hit-and-run performance rating--.

Column 24, line 8, change "an" to --can--.

Signed and Sealed this

Sixth Day of February, 1990

*Attest:*

JEFFREY M. SAMUELS

*Attesting Officer*

*Acting Commissioner of Patents and Trademarks*